United States Patent [19]

Kumokawa et al.

[11] Patent Number: 4,498,067

[45] Date of Patent: Feb. 5, 1985

[54] SMALL-SIZE INDUCTOR

[75] Inventors: Takashi Kumokawa; Minoru Tamada, both of Yokaichi; Ichiji Shimamoto; Kiyoko Uda, both of Shiga, all of Japan

[73] Assignee: Murata Manufacturing Co., Ltd., Japan

[21] Appl. No.: 434,264

[22] Filed: Oct. 14, 1982

[30] Foreign Application Priority Data

Apr. 20, 1981 [JP] Japan ..... 56-57230[U]

[51] Int. Cl.[3] ..... H01F 15/02; H01F 15/10

[52] U.S. Cl. ..... 336/65; 336/83; 336/96; 336/192; 336/212

[58] Field of Search ..... 336/192, 83, 65, 233, 336/96, 212

[56] References Cited

U.S. PATENT DOCUMENTS

| | | | |
|---|---|---|---|
| 3,480,896 | 11/1969 | Neuman | 336/83 |
| 3,551,864 | 12/1970 | Sweeney et al. | 336/83 |
| 4,149,135 | 4/1979 | Roespel et al. | 336/83 X |
| 4,314,221 | 2/1982 | Satou et al. | 336/83 |
| 4,393,364 | 7/1983 | Suda et al. | 336/83 X |

FOREIGN PATENT DOCUMENTS

| | | | |
|---|---|---|---|
| 2229859 | 1/1974 | Fed. Rep. of Germany | 336/233 |
| 664642 | 6/1964 | Italy | 336/83 |
| 26419 | 3/1981 | Japan | 336/83 |
| 17222 | of 1906 | United Kingdom | 336/83 |

*Primary Examiner*—Thomas J. Kozma

*Attorney, Agent, or Firm*—Ostrolenk, Faber, Gerb & Soffen

[57] ABSTRACT

A small-size inductor for use in a wrist watch or a pocket size calculator includes a base member, a coil and a cap member. The base member is defined by a base plate having first and second opposite faces, a core projection extending from the first face of the base plate, and first and second terminals deposited in a spaced relation with each other on the second face of the base plate. The base plate has at least first and second recesses formed in its peripheral face. The coil is mounted on the core projection. The coil has first and second lead wires, in which the first lead wire extends through the first recess and is connected to the first terminal and the second lead wire extends through the second recess and is connected to the second terminal. The cap member is fittingly mounted on the base member to enclose the coil in a cavity defined by the cap member and the base member.

10 Claims, 7 Drawing Figures

SMALL-SIZE INDUCTOR

BACKGROUND OF THE INVENTION

1. Field of the invention

The present invention relates to an inductor and, more particularly, to a small-size inductor capable of being installed in a small devices, such as a wrist watch or a pocket size calculator.

2. Description of the Prior Art

Recently, electronic wrist watches and electronic pocket size calculators and other similar devices employ an inductor for producing a step-up voltage, which is used, for example, for actuating a buzzer to produce a sound. Such an inductor has a very small size, for example, a diameter of about 2–5 millimeters and a height of about 2–4 millimeters, and, therefore, it is referred to as a small-size inductor.

A prior art small-size inductor of the above described type is shown in FIG. 1, and which includes a base member 3 made of ferrite, a terminal plate 9 made of electrically non-conductive material, such as synthetic resin, a coil 11 formed by a very thin lead wire and a cap member 12 also made of ferrite. The base member 3 has a circular bottom wall 3*a*, a core 10 mounted at the center of the bottom wall 3*a*, and a cylindrical side wall 3*b* having a pair of recesses 1 and 2 formed at opposite sides thereof. The terminal plate 9 seats on the bottom wall 3*a* of the base member 3 such that an opening 8 of the terminal member 9 receives the core 10 and a pair of tongues 6 and 7 of the terminal member 9 extends outwardly from the cylindrical wall 3*b* through the recesses 1 and 2, respectively. The coil 11 is also mounted on the core 10, and a pair of lead wires extending from the coil 11 are wound around and connected to terminals 4 and 5, respectively, provided at tongues 6 and 7. The cap member 12 includes a cylindrical wall having a pair of recesses formed therein. The cap member 12 is mounted on the base member 3 to define a magnetic circuit path through the center hole and around the outer face of the coil 11.

According to the prior art inductor, the thickness of the terminal plate 9 affects the height of the inductor such that the thicker the terminal plate 9, the greater the height of the inductor. Therefore, in order to reduce the size of the inductor, particularly its height, one approach is to reduce the thickness of the terminal plate 9. When the terminal plate 9 is made considerably thin, however, the tongues 6 and 7 will be easily bent, which results in damage of the small-size inductor. For example, when a part feeder mounts the small-size inductor automatically on a circuit board 13, the vibration of the feeder is transmitted to the terminal plate 9, causing bending of the tongues 6 and 7. When tongues 6 and 7 are bent, they may be broken, or the lead wires connected to the tongues 6 and 7 may be cut.

Another approach to reduce the size of the small-size inductor is to reduce the thickness of the walls defining the base member 3 and the cap member 12. Since the base member 3 and the cap member 12 are made of ferrite, the thickness of such walls can not be made thinner than a certain thickness to ensure a certain level of inductance and also mechanical strength.

Because of the above reasons, the prior art small-size inductor has a disadvantage in that its size can not be made smaler than a certain limited size.

Also, when mounting the prior art inductor on a circuit board 13, it is necessary to form a circular opening 14 in the circuit board 13 so as to receive the bottom wall 3*a* resulting in contact between electrodes 13*a* and 13*b* deposited on the circuit board 13 and the tongues 6 and 7, respectively. If the openings 14 were not provided, the tongues 6 and 7 would be held in a spaced relation with the electrodes 13*a* and 13*b*, respectively, causing difficulty in applying solder between the terminal 4 and the electrode 13*a* and also between the terminal 5 and the electrode 13*b*.

From the above, it should be understood that the prior art small-size inductor has another disadvantage in that the circuit board 13 for mounting the inductor must be previously provided with opening 14, resulting in increase in the number of manufacturing steps, and at the same time, the back surface of the circuit board 13 where the opening 14 is formed can not be used for mounting or forming circuit parts, resulting in decrease of available areas for mounting or forming circuit parts.

Furthermore, since the prior art small-size inductor has the tongues extending outwardly from the base member 3, the maintenance of the inductors before being mounted on the circuit board requires much care.

SUMMARY OF THE INVENTION

The present invention has been developed with a view to substantially solve the above described disadvantages and has for its essential object to provide an improved small-size inductor which can be formed in a size smaller than that of the prior art inductor.

It is also an essential object of the present invention to provide a small-size inductor of the above described type which does not have a terminal plate with tongue portions extending from its body portion, resulting in easy maintenance.

It is also a further object of the present invention to provide an small-size inductor of the above described type which can be mounted on a circuit board without providing any opening in the circuit board, resulting in a simplification of the steps required to manufacture the circuit board and in an increase in the area of the circuit board available for mounting electric parts.

It is another object of the present invention to provide an small-size inductor of the above described type which can readily be manufactured at low cost.

In accomplishing these and other objects, a small-size inductor according to the present invention comprises a base member, a coil and a cap member. The base member is defined by a base plate having first and second opposite faces, a core projection extending from the first face of the base plate, and first and second terminals deposited in a spaced relation with each other on the second face of the base plate. The base plate has at least first and second recesses formed in its peripheral face.

The coil is mounted on the core projection. The coil has first and second lead wires, in which the first lead wire extends through the first recess and is connected to the first terminal and the second lead wire extends through the second recess and is connected to the second terminal.

The cap member is fittingly mounted on the base member to enclose the coil in a cavity defined by the cap member and the base member.

BRIEF DESCRIPTION OF THE DRAWINGS

These and other objects and features of the present invention will become apparent from the following description taken in conjunction with preferred embodiments thereof with reference to the accompanying drawings, throughout which like parts are designated by like reference numerals, and in which.

DESCRIPTION OF THE PREFERRED EMBODIMENTS

Figure 1:
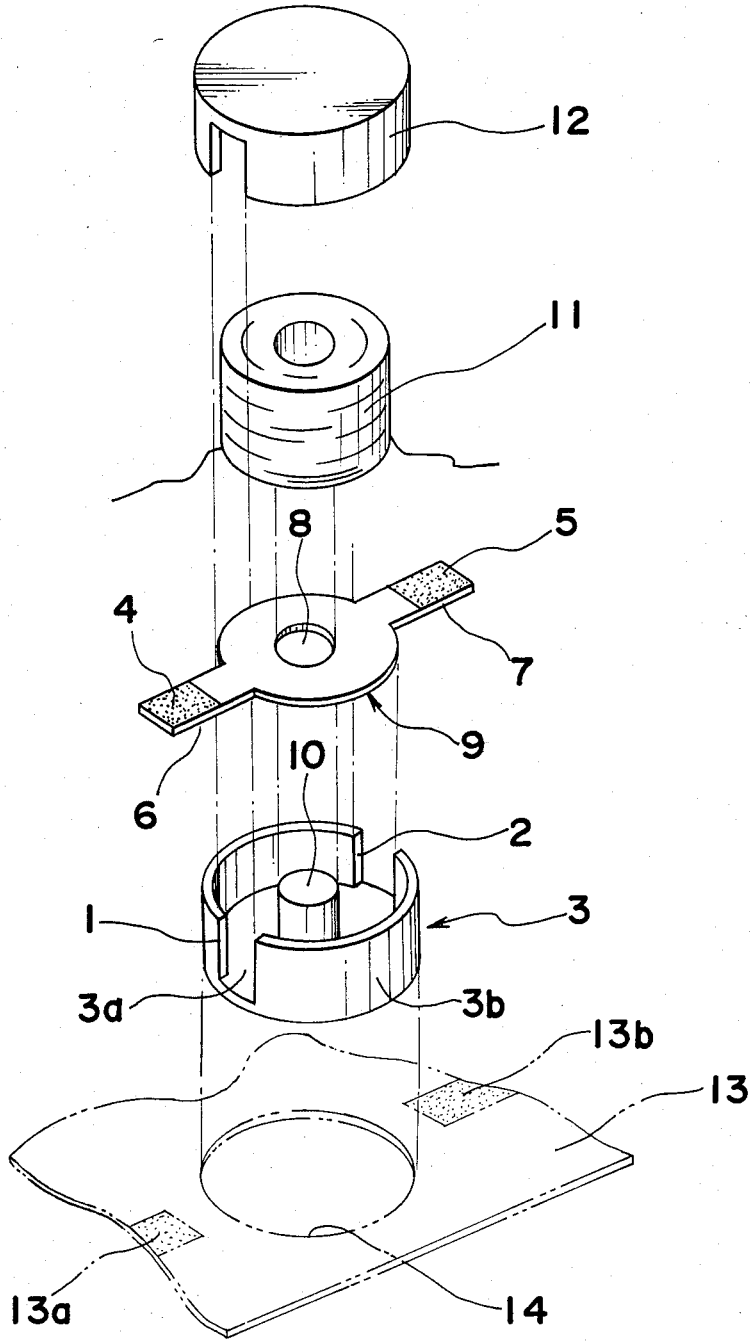
Fig. 1 PRIOR ART
FIG. 1 is an exploded view of a small-size inductor according to one prior art.
Figure 2:
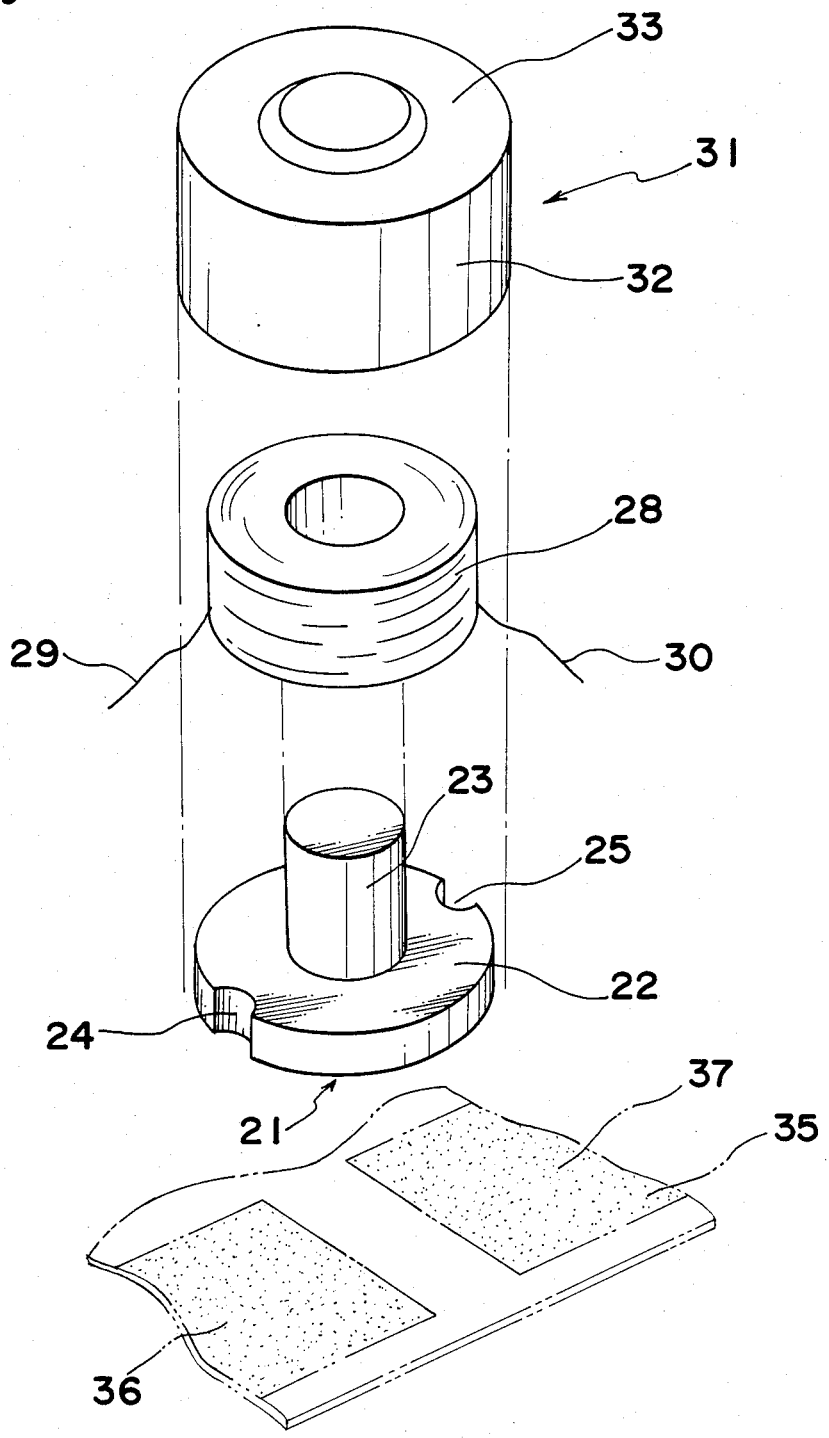
FIG. 2 is an exploded view of a small-size inductor according to a first embodiment of the present invention.
Figure 3:
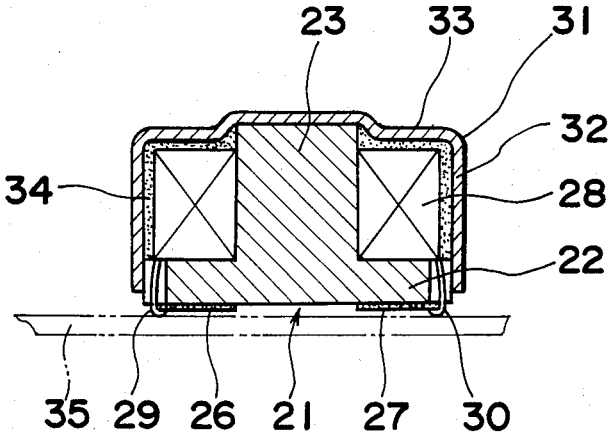
FIG. 3 is a cross-sectional view of the inductor shown in FIG. 2.

Referring to FIGS. 2 and 3, a small-size inductor according to a first embodiment of the present invention comprises a base member 21, a coil 28 and a cap member 31. Each of these members if described in detail below.

The base member 21 is formed of ferrite and is defined by a circular bottom plate 22 and a projection 23 extending perpendicularly and upwardly from the center of the bottom plate 22. As will be understood from the description below, the projection 23 serves as a core for receiving the coil 28. The circular bottom plate 22 has a pair of recesses 24 and 25 formed on opposite sides thereof in opposed relation to each other for extending the lead wires from the coil therethrough. Since such lead wires are very thin, the edges of the recesses 24 and 25 may cut the lead wire. To prevent this, such edges of the recesses 24 and 25 are ground by way of barrel finishing in which a number of base members 21 are thrown into a barrel containing abrasive particles and water, and thereafter, the barrel is shaken or rolled. When this is done, not only the recess edges but also other edges and faces, particularly the top face of the projection 23, are made very smooth (rounded).

Figure 4:
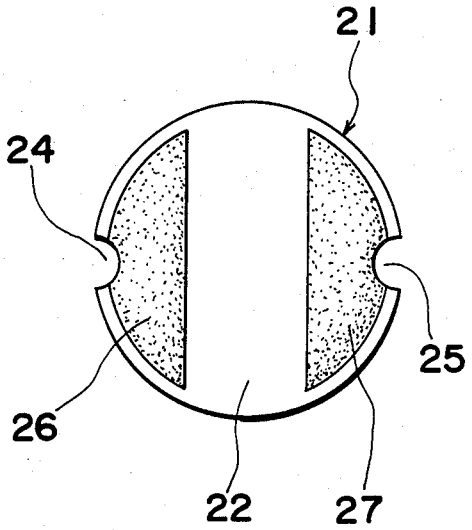
FIG. 4 is a bottom plan view of a base member shown in FIGS. 2 and 3.

As best shown in FIG. 4, a pair of terminals 26 and 27 are deposited on the bottom face of the base member 21 through suitable depositing steps, such as coating or vacuum deposition. Each of the terminals 26 and 27 has a semi-circular configuration with its curved edge located inwardly of the outer curved edge of the bottom plate 22 so as to provide a predetermined space between each of the terminals 26 and 27 and the bottom edge of the cap member 31 which is located at the periphery of the bottom plate 22, as shown in FIG. 3, thus, electrically insulating the terminals 26 and 27 from the cap member 31. As apparent from FIG. 4, the edges defining the recesses 24 and 25 are partly flush with the edges defining the terminals 26 and 27, respectively.

It is to be noted that each of the terminals 26 and 27 is made of a material having high electric conductivity, such as Ag, Ag—Pd, Ni, Cu, etc. On the other hand, the base member 21 is made of a ferrite having high specific resistance, such as Ni—Zn ferrite, so as to electrically insulate terminals 26 and 27 from each other. According to a preferred embodiment, the Ni—Zn ferrite comprises Ni and Zn as main component and Cu, Mg, Co, Si, Mo, Pb, etc. as additives according to the requirements. In the case where the base member 21 is made of a ferrite having low specific resistance, such as Mn—Zn ferrite, it is necessary to provide an electric insulation layer between the bottom face of the base member 21 and the terminals 26 and 27.

The coil 28 is formed by a very thin lead wire having a diameter about 10–70 micrometers with a polyurethane coating. According to the preferred embodiment, the wire is further coated with a fusible layer, such as nylon layer or epoxy resin layer. In the case where the core 23 is made of high specific resistance material, such as Ni—Zn ferrite, the coil 28 can be mounted directly on the core 23. On the other hand, when the core 23 is made of low specific resistance material, such as Mn—Zn ferrite, a suitable electric insulation layer should be provided between the coil 28 and the core 23.

The mounting of the coil 28 on the core 23 can be effected during the winding of the coil 28 or after the winding of the coil 28. Furthermore, in order to prevent each winding of the coil 28 from being separated from other windings, an electric current is fed through the wire wound in a shape of coil 28 so as to heat-up and melt the fusible layer and, thereafter, when the coil 28 is cooled down, the windings are held together. Instead of providing the current, the wires can be bonded together by the steps of immersing the wire in a solvent before winding, and during the winding, the solvent bonding is effected. When the coil is mounted on the core 23, the opposite end portions 29 and 30 of the coil 28 are held in the recesses 24 and 25, respectively. Then, the end of the lead wire 29 is stripped and soldered to the terminal 26. Similarly, the end of the lead wire 30 is stripped and soldered to the terminal 27.

The cap member 31 is formed by a material capable of being processed through pressing and having a permeability greater than that of the base member 21. According to the preferred embodiment, the cap member 31 is formed by a metallic magnetic material of Ni—Fe, which is known as Permalloy, or Al—Fe. The cap member 31 is defined by a cylindrical side wall 32 and a top plate 33 and is formed by the pressing. The inner diameter of the cylindrical side wall 32 is equal to or slightly greater than the diameter of the base plate 22. According to the preferred embodiment, the center portion of the top plate 33 is further recessed to receive the top face of the projection 23.

The base member 21, coil 28 and the cap member 31 are assembled together in a manner described below.

First, the cap member 31 is so held with the top plate 33 located below the wall 32 (the inverse of the orientation of FIG. 3 to permit a predetermined amount of bonding agent 34 to be poured into the cap member 31. According to the preferred embodiment, the bonding agent 34 is a heat-resistant inorganic bonding agent consisting mainly of alumina, silica or alumina-silica, such as Aron Ceramic (manufactured by Toa Gosei Chemical Industry Co. Ltd. of Japan). Thereafter, the base member 21 with the coil 28 mounted thereon is inserted into the cap member 31 until the top face of the projection 23 contacts the inner face of the plate 33. At this moment, the inner face of the cylindrical wall 32 fittingly engages the peripheral face of the bottom plate 22, as best shown in FIG. 3, defining a cavity between the cap member 31 and the base member 21. During the insertion of the base member 21 into the cap member 31, the bonding agent 34 flows into the space not only between the coil 28 and the cap member 31, but also between the base member 21 and the coil 28 and between the windings in the coil 28. Furtheremore, some bonding agent intrudes between the inner face of the cylindrical wall 32 and the peripheral face of the bottom plate 22. In this sense, the bonding agent 34 serves as a filler. Accordingly, the base member 21, coil 28 and cap member 31 are secured in a position shown in FIG. 3.

Since the top face of the projection 23 fittingly contacts the inner face of the top plate 33, and the peripheral face of the bottom plate 22 fittingly contacts the inner face of the cylindrical wall 32, a closed magnetic circuit is defined through the projection 23, cap member 33 and the bottom plate 22. To reduce the magnetic resistance through the magnetic circuit and to increase the inductance value of the coil, the contact between the base member 21 and the cap member 32 should be effected fittingly and tightly. To this end, the faces of the base member 21, particularly the top face of the projection 23 and the peripheral face of the bottom plate 22 are previously polished through the above mentioned barrel finishing or through any other known finishing technique.

Instead of a heat-resistant inorganic bonding agent, the filler 34 can be an epoxy type bonding agent, such as UNISET A-312 manufactured by Amicon Corporation of U.S.A.

When mounting the small-size inductor of the present invention on a circuit board 35, all that is necessary is to apply solder between the terminal 26 and an electrode 36 provided on the circuit board 35 and also between the terminal 27 and an electrode 37. This can be done by applying molten solder from the side edge of the base plate 22, or by the steps of applying a solder bead previously on each of the terminals 26 and 27, and electrodes 36 and 37, and, thereafter, placing the small-size inductor in proper position over the circuit board 35, and then, applying heat to solder beads to effect the rigid mechanical and electrical connection.

Figure 5:
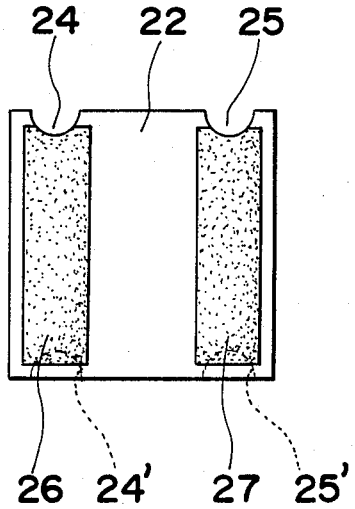
FIG. 5 is a view similar to FIG. 4, but particularly showing a modification thereof.

It is to be noted that the base plate 22 can be formed in a shape other than circular, such as rectangular, as shown in FIG. 5. In this case, the cap member 31 should be so formed as to have a side wall 32 formed in a rectangular shape when viewed from the bottom in FIGS. 2 or 3. The recesses 24 and 25 for locating lead wires 29 and 30, respectively, can be formed at any portion along the peripheral side of the base plate 22. Preferably, however, the recess 24 is so located as to partly intrude into the terminal 26, and the recess 25 is so located as to partly intrude into the terminal 27 so that the edges defining the recesses 24 and 25 are partly in flush with the edges defining the terminals 26 and 27, respectively. Thus, the lead wires 29 and 30, which have passed through the recesses 24 and 25, respectively, can be simply soldered to the terminals 26 and 27, respectively. In FIG. 5, the recesses 24 and 25 are shown as formed on one peripheral side of the base plate 22 so that during the soldering of the lead wires 29 and 30 to the terminals 26 and 27, the end portions of the lead wires 29 and 30 are bent in the same direction, resulting in simple manufacturing steps. To facilitate the manufacturing steps, further recesses 24' and 25' as shown by a dotted line are formed, so that it is not necessary to consider the direction of base plate 22. It is needless to said that the above described arrangement of the recesses can be applied to the base plate 22 of FIG. 4.

Figure 6:
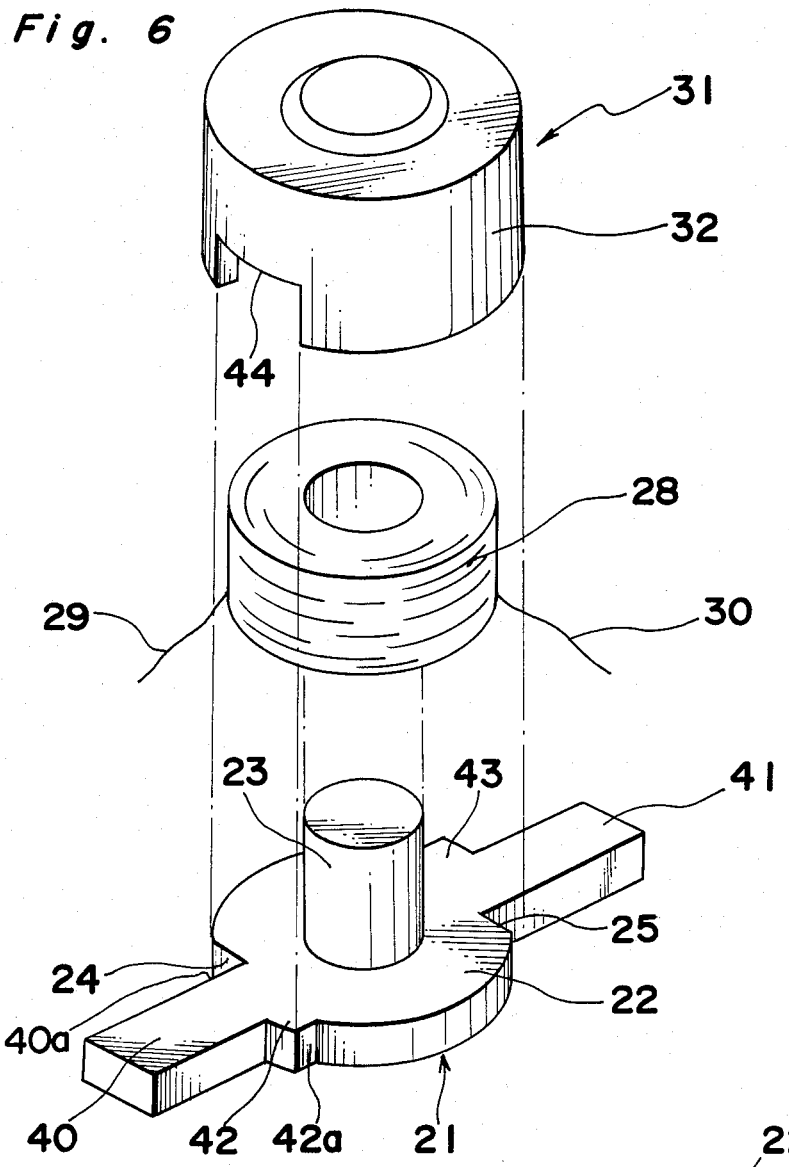
FIG. 6 is an exploded view of a small-size inductor according to a second embodiment of the present invention.

Referring to FIG. 6, there is shown an exploded view of a small-size inductor according to a second embodiment of the present invention. When compared with the small-size inductor of the first embodiment, the inductor of the second embodiment differs in base member 21 and cap member 31.

Figure 7:
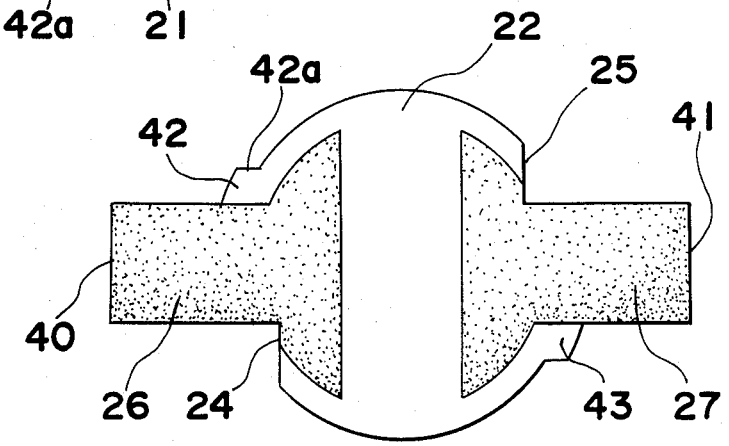
FIG. 7 is a bottom plan view of a base member shown in FIG. 6.

The base member 21 of the second embodiment has a pair of arms 40 and 41 extending radially and outwardly from the base plate 22 in opposite directions. At the end of the arm 40 connected to the base plate 22, a recess 24 is formed on one side and a step 42 is formed on the other side thereof. Similarly, at the end of the arm 41 connected to the base plate 22, a recess 25 is formed on one side and a step 43 is formed on the other side thereof. As shown in FIG. 7, terminals 26 and 27 are deposited on the bottom face of the bottom plate 22. The terminal 26 is located on the entire bottom face of the arm 40 and also partly on the bottom face of the bottom plate 22. Similarly, the terminal 27 is located on the entire bottom face of the arm 41 and also partly on the bottom face of the bottom plate 22. As apparent from FIG. 7, the edges defining the recesses 24 and 25 are partly flush with the edges defining the terminals 26 and 27, respectively.

The cap member 31 of the second embodiment has a pair of rectangular recesses (only one recess 44 is seen in FIG. 6) formed in opposite sides of the cylindrical side wall 32 thereof. The width of the rectangular recesses is equal to or slightly greater than the distance between the side 42*a* of the step 42 and the side 40*a* of the arm 40, and the depth of the rectangular recess is approximately equal to the thickness of the base plate 22. When mounting the cap member 31 on the base member 21, the rectangular recesses receive the corresponding arms and steps, and at the same time, the cylindrical side wall 32 fittingly receives the base plate 21.

According to the second embodiment, since the terminals 26 and 27 are located at the very edge of the respective arms 40 and 41, the soldering of the inductor on the circuit board can be carried out easily. More particularly, when soldering, the inductor is placed on the circuit board at a proper position and then a molten solder is applied around the arms 40 and 41. Since the terminals 26 and 27 extend to the very edge of the arms 40 and 41, the molten solder can easily intrude into the space between the terminal and the electrode. Furthermore, the intrusion of the molten solder is effected from every edge of the arms and, therefore, the soldering can be carried out effectively.

According to the small-size inductor of the present invention, since there is no terminal plate, the height of the inductor can be reduced.

Furthermore, since the lead wires 29 and 30 from the coil 28 are connected not to tongues which are subjected to vibration but to base plate 22, such lead wires 29 and 30 will not be cut during the manufacturing process.

Moreover, since the cap member 31 is made of a metallic magnetic material having a high permeability, the thickness of the cap member 31 can be reduced and, at the same time, the mechanical strength of the cap member can be improved.

Furthermore, since the inductor of the present invention can be soldered to the circuit board without preparing any openings in the circuit board, the steps for mounting the inductor can be carried out simply and, at the same time, the steps for preparing the circuit board can be simplified. Moreover, since the soldering of the inductor of the present invention on the circuit board is effected on only one surface of the circuit board, the other surface of the circuit board can be used for some other purposes, e.g., mounting other circuit parts.

Although the present invention has been fully described with reference to several preferred embodiments, many modifications and variations thereof will now be apparent to those skilled in the art, and the scope of the present invention is therefore to be limited not by the details of the preferred embodiments described above, but only by the terms of appended claims.

What is claimed is:

1. A small-size inductor comprising:

a base member defined by a base plate having first and second opposite faces separated by at least one side surface which lies generally perpendicular to said first and second faces, a core projection extending from said first face of said base plate generally perpendicular to said first face, and first and second terminals deposited in a spaced relation with each other on said second face of said base plate, said first and second terminals being located on said second face only and being entirely spaced from the outer periphery of said second face, said base plate having at least first and second recesses formed in its peripheral face, said first and second recesses extending to said first and second terminals, respectively;

a coil mounted on said core projection, said coil having first and second lead wires extending therefrom, said first lead wire extending through said first recess and connected to said first terminal and said second lead wire extending through said second recess and connected to said second terminal; and a cap member fittingly mounted on said base member to enclose said coil in a cavity defined by said cap member and the base member, said cap member being formed of a metallic magnetic material having a permeability greater than that of said base member, said cap member including a top plate in contact with a top surface of said core projection and further including at least one side wall extending down from said top plate and tightly contacting said at least one side surface along substantially the entire perimeter thereof.

2. A small-size inductor as claimed in claim 1, further comprising first and second arms extending radially and outwardly from said base plate, said cap member having first and second recesses to receive said first and second arms, respectively.

3. A small-size inductor as claimed in claim 1, wherein said base member is made of Ni—Zn ferrite.

4. A small-size inductor as claimed in claim 1, wherein said cap member is made of a material capable of being processed through pressing and having a permeability greater than that of the base member.

5. A small-size inductor as claimed in claim 1, further comprising a filler provided in a space in said cavity.

6. A small-size inductor as claimed in claim 5, wherein said filler is heat-resistant inorganic bonding agent.

7. A small-size inductor as claimed in claim 5, wherein said filler is epoxy resin bonding agent.

8. A small-size inductor as claimed in claim 5 wherein said filler extends along substantially the entire inner periphery of said at least one side wall except the portion of said at least one side wall contacting said at least one side surface.

9. A small-size inductor as claimed in claim 5, wherein said filler also extends along substantially the entire inner surface of said one top plate except that portion of said inner surface of said top plate contacting said top surface of said core projection.

10. A small-size inductor as claimed in claim 1, further including a recess formed in said top plate of said cap member, said recess having a size and shape substantially equal to the size and shape of said to surface of said core projection, said recess receiving said surface of said core projection therein.

* * * * *